US011244621B2

(12) United States Patent
Lin et al.

(10) Patent No.: US 11,244,621 B2
(45) Date of Patent: Feb. 8, 2022

(54) DIFFERENTIAL INPUT CIRCUIT AND DRIVING CIRCUIT

(71) Applicant: NOVATEK MICROELECTRONICS CORP., HsinChu (TW)

(72) Inventors: Chieh-An Lin, Taipei (TW); Tzu-Chien Tzeng, Hsinchu (TW)

(73) Assignee: NOVATEK MICROELECTRONICS CORP., Hsinchu (TW)

( * ) Notice: Subject to any disclaimer, the term of this patent is extended or adjusted under 35 U.S.C. 154(b) by 156 days.

(21) Appl. No.: 16/820,805

(22) Filed: Mar. 17, 2020

(65) Prior Publication Data

US 2021/0295775 A1 Sep. 23, 2021

(51) Int. Cl.
*G09G 3/3225* (2016.01)
*G09G 3/3258* (2016.01)

(52) U.S. Cl.
CPC ... *G09G 3/3258* (2013.01); *G09G 2310/0289* (2013.01); *G09G 2320/04* (2013.01)

(58) Field of Classification Search
None
See application file for complete search history.

(56) References Cited

U.S. PATENT DOCUMENTS

| | | | | |
|---|---|---|---|---|
| 9,412,308 | B2 | 8/2016 | Min et al. | |
| 9,530,356 | B2 | 12/2016 | Min et al. | |
| 10,497,308 | B1 * | 12/2019 | Tseng | G09G 3/3233 |
| 2014/0368415 | A1 | 12/2014 | Kim et al. | |
| 2018/0114815 | A1 * | 4/2018 | Lee | H01L 51/50 |

* cited by examiner

*Primary Examiner* — Carl Adams
(74) *Attorney, Agent, or Firm* — McClure, Qualey & Rodack, LLP

(57) ABSTRACT

A differential input circuit and a driving circuit including the same are provided. The differential input circuit transforms an analog voltage signal corresponding to a sensing line on an OLED panel to a pair of differential input signals being output to a gain amplifier. The differential input circuit includes a sampling circuit and a scaling circuit. The sampling circuit receives the analog voltage signal and a reference voltage through a first scaling path and a second scaling path, respectively. The scaling circuit includes a first scaling path and a second scaling path. The first scaling path and the second scaling path collectively generate the pair of differential input signals, based on a first shift voltage, a first scaled voltage, a second shift voltage, and a second scaled voltage. The first shift voltage is less than the second shift voltage.

20 Claims, 10 Drawing Sheets

DIFFERENTIAL INPUT CIRCUIT AND DRIVING CIRCUIT

BACKGROUND OF THE INVENTION

Field of the Invention

The invention relates in general to a differential input circuit and a driving circuit, and more particularly to a differential input circuit with sample and hold function and a driving circuit capable of transforming a sensed voltage signal to a low-voltage input of an analog-to-digital converter.

DESCRIPTION OF THE RELATED ART

FIG. 1 is a schematic diagram illustrating the operation of an OLED pixel circuit. An organic light-emitting diode (hereinafter, OLED) panel includes OLED pixel circuits being arranged in a matrix, and an OLED pixel circuit 17 located at an m-th column and n-th row can be represented as $PXL_{mn}$. The OLED pixel circuit 17 is electrically connected to a source driver through an m-th data line $DL_m$ and an m-th sensing line $SL_m$, and to a gate driver through an n-th gate line $GL_n$. Both the source driver and the gate driver receive control signals specific to the OLED pixel circuit 17 from a timing controller.

When the OLED pixel circuit ($PXL_{mn}$) 17 is selected to display, the gate control signal being transmitted by the n-th gate line $GL_n$ switches on the transistor 17*a*, and the data signal being transmitted through the m-th data line $DL_m$, charges the pixel capacitor $C_{pxl}$. Once the cross voltage of the pixel capacitor $C_{pxl}$ is sufficient to turn on the driving transistor 17*b* (for example, a thin film transistor, hereinafter, TFT), a pixel driving current $I_{drv}$ generates and drives the OLED 17*d*.

Characteristics of the OLED pixel circuit 17, for example, a threshold voltage Vth of the driving transistor 17*b* and the turn-on voltage of the OLED 17*d*, may shift or degrade with time passing. Thus, a sensing mechanism for detecting the OLED and/or TFT degradation must be introduced.

When the switch 17*c* is turned on, the OLED and/or TFT degradation can be measured based on signals sensed from the sensing lines on the OLED panel. An OLED data driver includes a display data driving circuit, and a sensing circuit for processing the signals sensed from the sensing lines. The sensing circuit has an analog-to-digital converter (hereinafter, ADC) to convert the sensed signal (which is an analog voltage signal) to digital sensing information to be transmitted to a timing controller or a core processor, which is responsible for data compensation on the image data to be displayed.

However, the range of the analog sensing signal is greater than the operating voltage range of the ADC. Therefore, a technique for transforming the analog sensing signal to the low-voltage range of the ADC is desired.

SUMMARY OF THE INVENTION

The invention is directed to a differential input circuit and a driving circuit including the same. The differential input circuit transforms an analog voltage signal in a single-end form to a pair of differential input signals for a gain amplifier, and the signal quality can be improved.

According to a first aspect of the present disclosure, a differential input circuit is provided. The differential input circuit transforms an analog voltage signal corresponding to a sensing line on an OLED panel to a pair of differential input signals being output to a gain amplifier. The differential input circuit includes a sampling circuit and a scaling circuit. The sampling circuit is configured to receive the analog voltage signal and a reference voltage. The sampling circuit includes a first sampling path and a second sampling path. The first sampling path is configured to selectively sample the analog voltage signal to generate a first sampling voltage between a first sensing terminal and a first reference terminal according to the analog voltage signal and the reference voltage. The second sampling path is configured to selectively sample the analog voltage signal to generate a second sampling voltage between a second reference terminal and a second sensing terminal according to the reference voltage and the analog voltage signal. The scaling circuit includes a first scaling path and a second scaling path. The first scaling path is electrically connected to the first sensing terminal and the first reference terminal. The first scaling path is configured to receive the first sampling voltage and a first shift voltage, down scale the first sampling voltage to a first scaled voltage, and generate one of the pair of differential input signals according to the first shift voltage and the first scaled voltage. The second scaling path is electrically connected to the second sensing terminal and the second reference terminal. The second scaling path is configured to receive the second sampling voltage and a second shift voltage, down scale the second sampling voltage to a second scaled voltage, and generate the other one of the pair of differential input signals according to the second shift voltage and the second scaled voltage. The first and the second shift voltages are direct current voltages, and the first shift voltage is less than the second shift voltage.

According to a second aspect of the present disclosure, a driving circuit of a display device is provided. The driving circuit includes a differential input circuit and a gain amplifier. The differential input circuit transforms an analog voltage signal corresponding to a sensing line on an OLED panel to a pair of differential input signals. The differential input circuit includes a sampling circuit and a scaling circuit. The sampling circuit is configured to receive the analog voltage signal and a reference voltage. The sampling circuit includes a first sampling path and a second sampling path. The first sampling path is configured to selectively sample the analog voltage signal to generate a first sampling voltage between a first sensing terminal and a first reference terminal according to the analog voltage signal and the reference voltage. The second sampling path is configured to selectively sample the analog voltage signal to generate a second sampling voltage between a second reference terminal and a second sensing terminal according to the reference voltage and the analog voltage signal. The scaling circuit includes a first scaling path and a second scaling path. The first scaling path is electrically connected to the first sensing terminal and the first reference terminal. The first scaling path is configured to receive the first sampling voltage and a first shift voltage, down scale the first sampling voltage to a first scaled voltage, and generate one of the pair of differential input signals according to the first shift voltage and the first scaled voltage. The second scaling path is electrically connected to the second sensing terminal and the second reference terminal. The second scaling path is configured to receive the second sampling voltage and a second shift voltage, down scale the second sampling voltage to a second scaled voltage, and generate the other one of the pair of differential input signals according to the second shift voltage and the second scaled voltage. The first and the second shift voltages are direct current voltages, and the first shift voltage is less than the second shift voltage. The gain amplifier is electrically connected to the differential input circuit. The gain amplifier includes a first input terminal, a second input terminal, a first output terminal, and a second output terminal. The gain amplifier is configured to receive the pair of differential input signals through the first and the second input terminals and generate a pair of differential output signals at the first and the second output terminals.

The above and other aspects of the invention will become better understood with regard to the following detailed description of the preferred but non-limiting embodiment(s). The following description is made with reference to the accompanying drawings.

BRIEF DESCRIPTION OF THE DRAWINGS

FIG. 7 is corresponding to the sixth duration T6 shown in FIG. 3B.

DETAILED DESCRIPTION OF THE INVENTION

Figure 1:
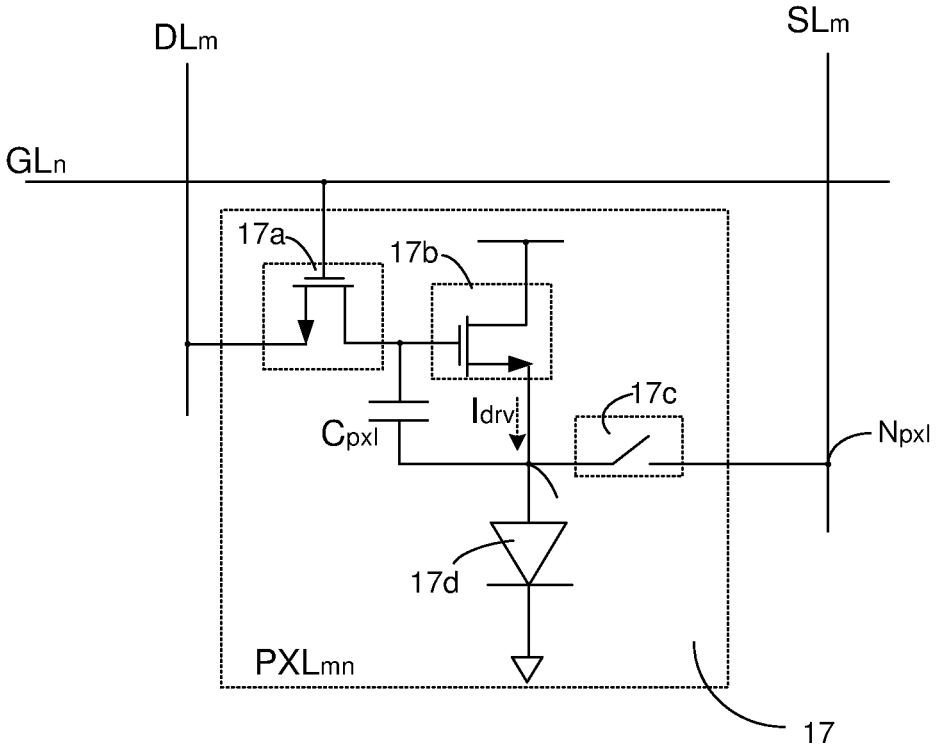
FIG. 1 (prior art)
FIG. 1 (prior art) is a schematic diagram illustrating the operation of an OLED pixel circuit.
Figure 2:
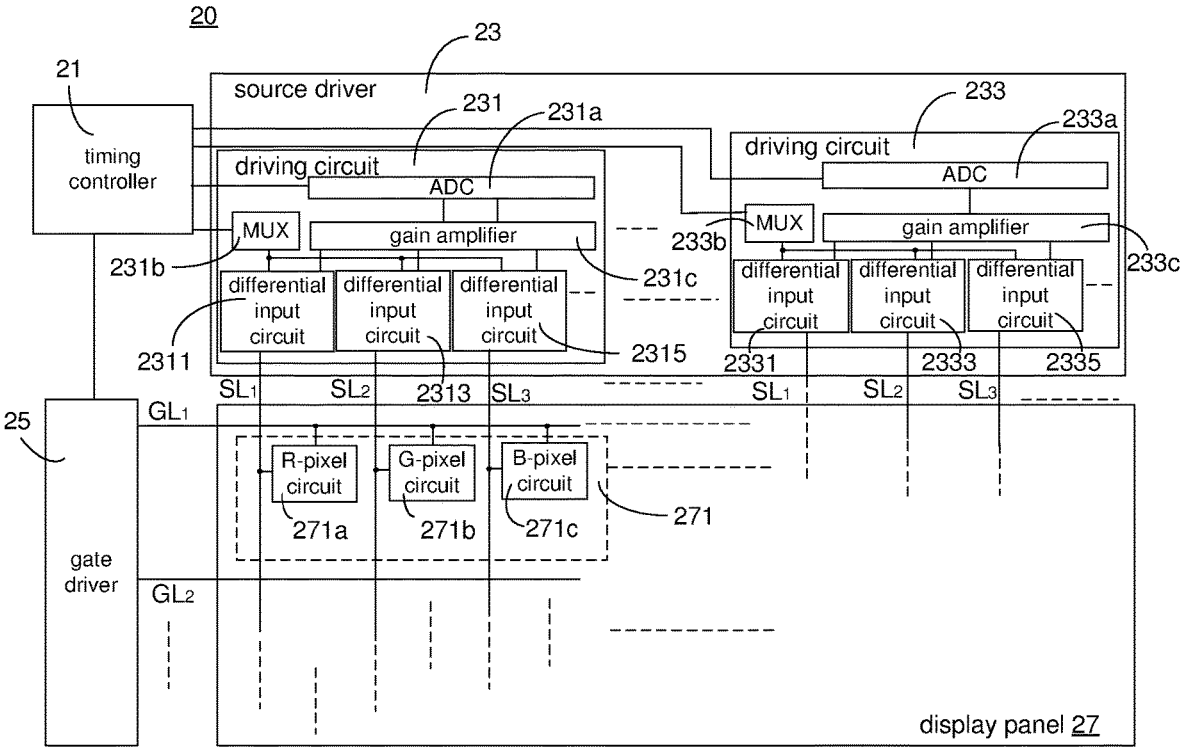
FIG. 2 is a schematic diagram illustrating components related to sensing the OLED and/or TFT degradation information of the pixel circuits in an OLED display device.

FIG. 2 is a schematic diagram illustrating components related to sensing the OLED and/or TFT degradation information of the OLED pixel circuits in an OLED display device. The OLED display device 20 includes a display panel 27, a source driver 23, a timing controller 21, and a gate driver 25. Both the timing controller 21 and the display panel 27 are electrically connected to the source driver 23 and the gate driver 25.

The display panel 27 display images with basic display elements 271 (pixels), and each of the basic display elements 271 includes an R-pixel circuit 271*a*, a G-pixel circuit 271*b*, and a B-pixel circuit 271*c*.

The source driver 23 may include one or multiple driving circuits 231, 233, and each of the driving circuits 231, 233 further includes an ADC 231*a*, 233*a*, a multiplexer (hereinafter, MUX) 231*b*, 233*b*, a gain amplifier 231*c*, 233*c*, and multiple differential input circuits 2311, 2313, 2315, 2331, 2333, 2335. As the components and interconnections in the driving circuits 231, 233 are similar, only the driving circuit 231 is illustrated. Each driving circuit may be implemented as a semiconductor chip.

The differential input circuit 2311 receives a first-channel (ch1) analog voltage signal through the sensing line $SL_1$. The differential input circuit 2313 receives a second-channel (ch2) analog voltage signal $V_{th(ch2)}$ through the sensing line $SL_2$. The differential input circuit 2315 receives a third-channel (ch3) analog voltage signal $V_{th(ch3)}$ through the sensing line $SL_3$. It is noted that FIG. 2 is an exemplary diagram, and the sensing lines $SL_1$~$SL_3$ and the pixel columns are not necessary to be in a one-on-one relationship. Based on the analog voltage signals respectively received from the sensing lines $SL_1$~$SL_3$, the OLED/TFT degradation information may be acquired.

According to the embodiment of the present disclosure, the number of driving circuits 231, 233 included in the source driver 23 is not limited. As shown in FIG. 2, the driving circuits 231, 233 may include multiplexers 231*b*, 231*c*, so that it is possible to equip one ADC in every driving circuit 231, 233.

After receiving the analog voltage signals from the sensing lines $SL_1$~$SL_3$, the differential input circuits 2311, 2313, 2315 samples, and scales down the analog voltage signals. Then, the ADCs 231*a*, 233*a* transform the scaled analog voltage signals into digitals signal representing ADC codes. The digital signals are further transmitted to the timing controller 21.

As the digital signals originated from the analog voltage signals carrying the OLED and/or TFT degradation information of the OLED pixel circuits, the ADC codes can reflect the degradation statuses of the OLED/TFT of the OLED pixel circuits.

According to the embodiment of the present disclosure, the multiplexer 231*b* receives selection signals $EN_{sel}$ from the timing controller 21. Basically, the selection signals $EN_{sel}$ are separately corresponding to the differential input circuits 2311, 2313, 2315, and the differential input circuits 2311, 2313, 2315. With the selection signals $EN_{sel}$, the ADC 231*a* rotativity generates the digital signals corresponding to the differential input circuits 2311, 2313, 2315. In consequence, the timing controller 21 is capable of compensating the OLED and/or TFT degradation of the OLED panel.

Figure 3A:
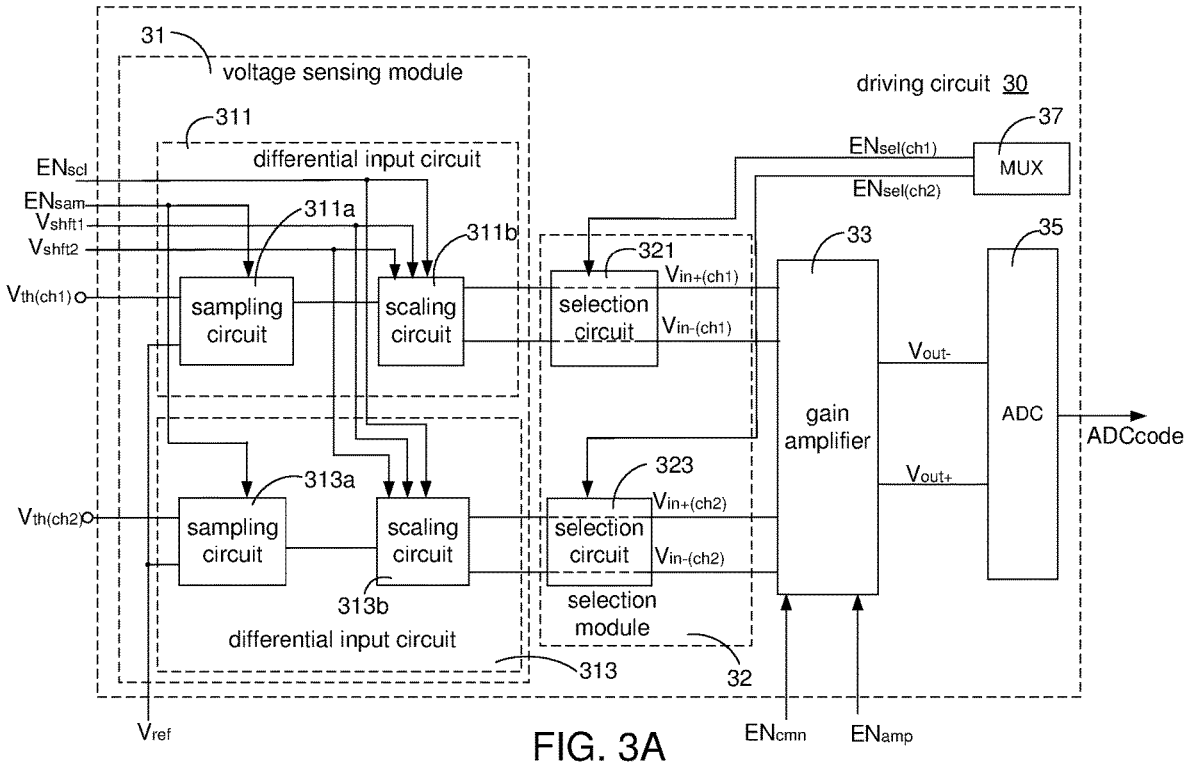
FIG. 3A is a schematic diagram illustrating a driving circuit according to the embodiment of the present disclosure.

FIG. 3A is a schematic diagram illustrating a driving circuit according to the embodiment of the present disclosure. The driving circuit 30 includes a voltage sensing module 31, a selection module 32, a gain amplifier 33, an ADC 35, and a multiplexer 27. Depending on the number of channels to be supported by the driving circuit 30, the number of differential input circuits 311, 313 in the voltage sensing module 31 may vary. That is, a plurality of differential input circuits 311, 313 generate their outputs to the gain amplifier 33 in a time-multiplexing manner.

For illustration purposes, the driving circuit 30 in FIG. 3A is assumed to support two channels. Thus, the voltage sensing module 31 includes two differential input circuits 311, 313, and the selection module 32 includes two selection circuits 321, 323. The differential input circuit 311 and the selection circuit 321 are respectively corresponding to a first channel (ch1), and the differential input circuit 313 and the selection circuit 323 are respectively corresponding to a second channel (ch2).

According to the embodiment of the present disclosure, some signals are channel specific, but others are not. For example, a reference voltage $V_{ref}$, a first shift voltage $V_{shft1}$, a second shift voltage $V_{shft2}$, a sampling enable signal $EN_{sam}$, and a scaling enable signal $EN_{scl}$ are signals being transmitted to both the differential input circuits 311, 313. On the other hand, the analog voltage signals $V_{th(ch1)}$, $V_{th(ch2)}$ and the channel selection signals $EN_{sel(ch1)}$, $EN_{sel(ch2)}$ are channel specific. In the following context, the signals specific to individual channels are marked in brackets if necessary.

The differential input circuit 311 includes a sampling circuit 311*a* and a scaling circuit 311*b*. Similarly, the differential input circuit 313 includes a sampling circuit 313*a* and a scaling circuit 313*b*. The signals and operations of the differential input circuit 313 are similar to those of the differential input circuit 311. Thus, only one differential input circuit is illustrated as an example in the following figures (FIGS. 4-8).

The sampling circuits 311*a*, 313*a* are respectively electrically connected to the scaling circuits 311*b*, 313*b*. Both the sampling circuits 311*a*, 313*a* are controlled by the sampling enable signal $EN_{sam}$ and the reference voltage $V_{ref}$. Both the scaling circuits 311*b*, 313*b* are controlled by the scaling enable signal $EN_{scl}$, the first shift voltage $V_{shft1}$, and the second shift voltage $V_{shft2}$.

The sampling enable signal $EN_{sam}$, and the scaling enable signal $EN_{scl}$ are pulse signals issued by the timing controller (not illustrated). The generation and timing of the sampling enable signal $EN_{sam}$, and the scaling enable signal $EN_{scl}$ are related and briefly illustrated in FIG. 3B. In short, the sampling enable signal $EN_{sam}$, and the scaling enable signal $EN_{scl}$ are alternatively generated, and the pulse of the sampling enable signal $EN_{sam}$ is prior to the pulse of the scaling enable signal $EN_{scl}$.

The scaling circuits 311*b*, 313*b* are respectively electrically connected to the selection circuits 321, 323. The selection circuit 321 transmits the pair of differential input signals corresponding to the first channel ($V_{in+(ch1)}$, $V_{in-(ch1)}$) to the gain amplifier 33, and the selection circuit 321 transmits the pair of differential input signals corresponding to the second channel ($V_{in+(ch2)}$, $V_{in-(ch2)}$) to the gain amplifier 33. The multiplexer 37 generates and transmits two channel selection signals $EN_{sel(ch1)}$, $EN_{sel(ch2)}$ to the selection circuits 321, 323, respectively. Basically, the channel selection signals $EN_{sel(ch1)}$, $EN_{sel(ch2)}$ are utilized to select which of the selection circuits 321, 323 can transmit their output signals to the gain amplifier 33.

The gain amplifier 33 may operate in a common mode ($M_{cmn}$) or in an amplification mode ($M_{amp}$). The timing controller controls the gain amplifier 33 to operate in the common mode ($M_{cmn}$) with a common mode signal $EN_{cmn}$, and in the amplification mode ($M_{amp}$) with an amplification mode signal $EN_{amp}$.

When the gain amplifier 33 operates in the common mode ($M_{cmn}$), none of the selection circuits 321, 323 transmits the differential input signals ($V_{in+(ch1)}$, $V_{in-(ch1)}$), ($V_{in+(ch1)}$, ($V_{in-(ch2)}$) to the gain amplifier 33.

When the gain amplifier 33 operates in the amplification mode ($M_{amp}$), one of the selection circuits 321, 323 transmits the pair of differential input signals ($V_{in+(ch1)}$, $V_{in-(ch1)}$), ($V_{in+(ch2)}$, $V_{in-(ch2)}$) to the gain amplifier 33, the gain amplifier 33 generates and transmits the pair of differential output signals ($V_{out+}$, $V_{out-}$) to the ADC 35, and the ADC 35 converts the differential output signals ($V_{out+}$, $V_{out-}$) to the digital signal. The input range of the ADC 35 is relatively lower than the voltage range of the analog voltage signal being sensed. The practical values of the input range and the output range of the ADC 35 are not limited.

Figure 3B:
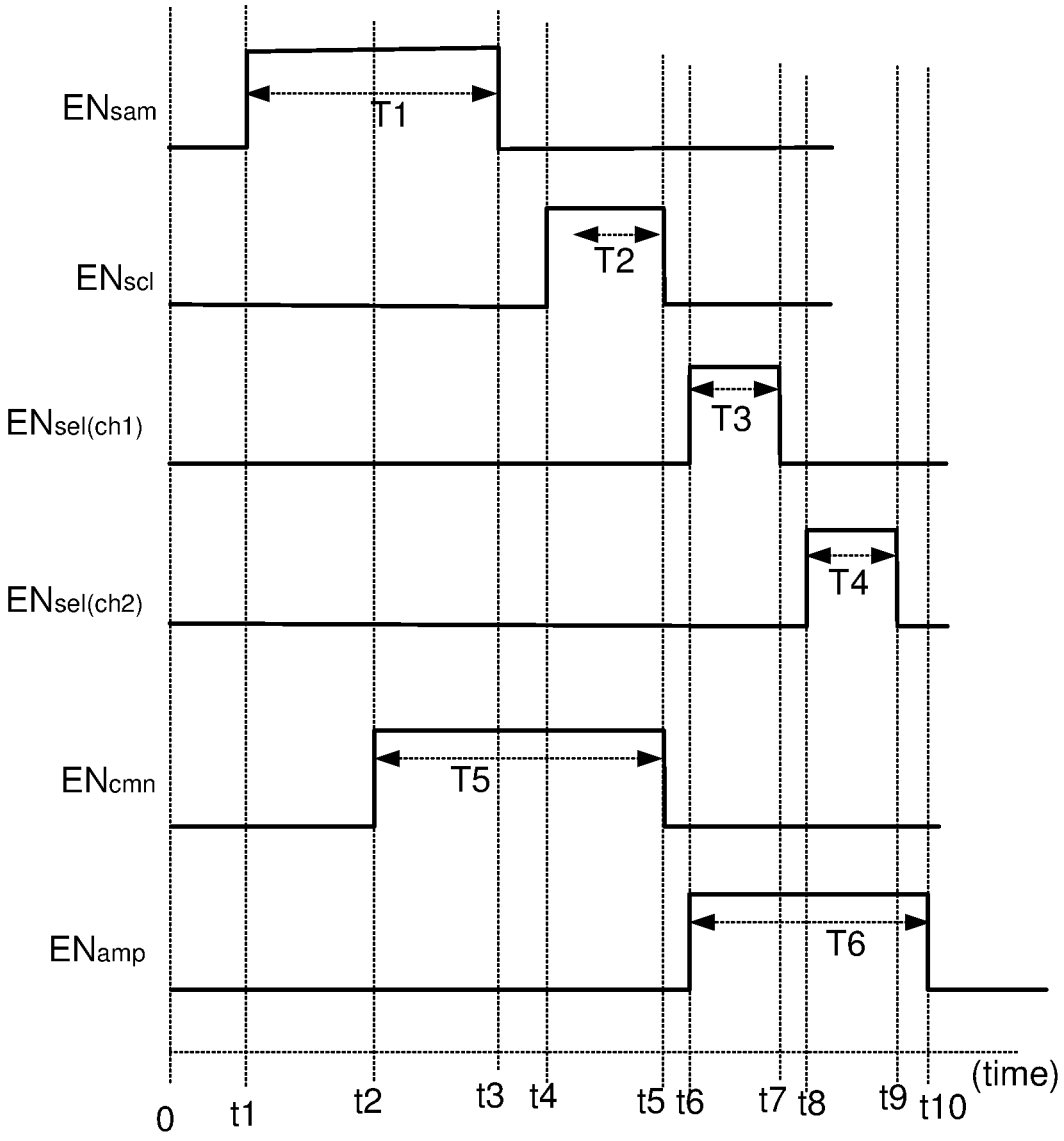
FIG. 3B is a waveform diagram illustrating changes of the signals shown in FIG. 3A.

FIG. 3B is a waveform diagram illustrating changes of the signals shown in FIG. 3A. The vertical axis represents different signals, and the horizontal axes represent time. The voltage levels of these signals shown here are examples and not limited in practical application.

The first waveform represents the sampling enable signal $EN_{sam}$, and the second waveform represents the scaling enable signal $EN_{scl}$. The third and the fourth waveforms represent channel selection signals ($EN_{sel(ch1)}$, $EN_{sel(ch2)}$) to be respectively transmitted to the selection circuits 321, 323. The fifth waveform is a common mode signal $EN_{cmn}$, and the sixth waveform is an amplification mode signal $EN_{amp}$.

The sampling enable signal $EN_{sam}$ significantly transits from a low voltage level to a high voltage level at time point t1, and transits from the high voltage level to the low voltage level at time point t3. The duration when the sampling enable signal $EN_{sam}$ is at the high voltage level is represented as a first duration T1. The sampling circuits 311*a*, 313*a* are enabled by the sampling enable signal $EN_{sam}$ during the first duration T1.

The scaling enable signal $EN_{scl}$ significantly transits from a low voltage level to a high voltage level at time point t4, and transits from the high voltage level to the low voltage level at time point t5. The duration when the scaling enable signal $EN_{scl}$ is at the high voltage level is represented as a second duration T2. The end time point of the first duration T1 is the same as or before the start time point of the second duration T2. The short duration between the first duration T1 and the second duration T2 can be defined to prevent signal confliction.

The sampling circuits 311*a*, 313*a* respectively sample the analog voltage signals $V_{th(ch1)}$, $V_{th(ch2)}$) during the first duration T1. During the second duration T2, the scaling circuit 311*b* generates a pair of differential input signals ($V_{in+(ch1)}$, $V_{in-(ch1)}$), and the scaling circuit 313*b* generates another pair of differential input signals ($V_{in+(ch2)}$, $V_{in-(ch2)}$).

The sampling circuits 311*a*, 313*a* simultaneously receive the sampling enable signal $EN_{sam}$, and the scaling circuits 311*b*, 313*b* simultaneously receive the scaling enable signal $EN_{scl}$. Alternatively speaking, operations of the sampling circuits 311*a*, 313*a* are synchronized, and operations of the scaling circuits 311*b*, 313*b* are synchronized. That is, the pair of differential input signals ($V_{in+(ch1)}$, $V_{in-(ch1)}$), and another pair of differential input signals ($V_{in+(ch2)}$, $V_{in-(ch2)}$)) are generated at the same time.

The channel selection signal $EN_{sel(ch1)}$ specific to the first channel (ch1) transits from the low voltage level to the high voltage level at time point t6, and transits from the high voltage level to the low voltage level at time point t7. The duration when the channel selection signal $EN_{sel(ch1)}$ specific to the first channel (ch1) is at the high voltage level is represented as a third duration T3. The end time point of the second duration T2 is the same as or before the start time point of the third duration T3. The short duration between the second duration T2 and the third duration T3 can be defined to prevent signal confliction.

The channel selection signal $EN_{sel(ch2)}$ specific to the second channel (ch2) transits from the low voltage level to the high voltage level at time point t8, and transits from the high voltage level to the low voltage level at time point t9. The duration when the channel selection signal $EN_{sel(ch2)}$ specific to the second channel (ch2) is at the high voltage level is represented as a fourth duration T4. The end time point of the third duration T3 is the same as or before the start time point of the fourth duration T4. The short duration between the third duration T3 and the fourth duration T4 can be defined to prevent signal confliction.

In FIG. 3B, the common mode signal $EN_{cmn}$ is assumed to transit from the low voltage level to the high voltage level at time point t2, and transits from the high voltage level to the low voltage level at time point t5. The duration when the common mode signal $EN_{cmn}$ is at the high voltage level is represented as a fifth duration T5.

According to the embodiment of the present disclosure, the gain amplifier 33 must acquire a common mode voltage $V_{cmn}$ before the selection module 32 receives the channel selection signals $EN_{sel(ch1)}$, $EN_{sel(ch2)}$. For example, the start time point of the fifth duration T5 can be between time point t1 and t4, and the end time point of the fifth duration T5 can be before or the same as the time point t6.

The amplification mode signal $EN_{amp}$ transits from the low voltage level to the high voltage level at time point t6, and transits from the high voltage level to the low voltage level at time point t10. The duration when the amplification mode signal $EN_{amp}$ is at the high voltage level is represented as a sixth duration T6. The end time point of the fifth duration T5 is the same as or before the start time point of the sixth duration T6. The short duration between the fifth duration T5 and the sixth duration T6 can be defined to prevent signal confliction.

Based on the waveforms shown in FIG. 3B, the differential input circuits 311, 313 transform the analog voltage signals corresponding to sensing lines to pairs of differential input signals ($V_{in+(ch1)}$, $V_{in-(ch1)}$), ($V_{in+(ch2)}$, $V_{in-(ch2)}$) of the gain amplifier 33. Details of the design and operation of the differential input circuit according to the embodiment of the present disclosure are illustrated below. For the sake of illustration, only one differential input circuit is illustrated as an example.

Figure 4:
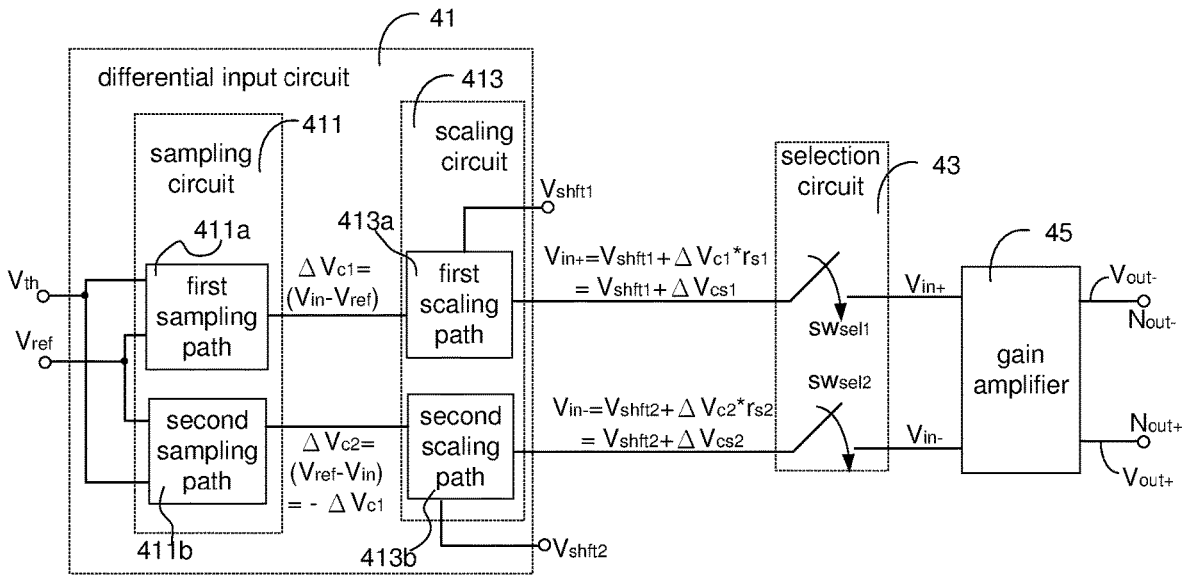
FIG. 4 is a schematic diagram illustrating a differential input circuit according to the embodiment of the present disclosure.

FIG. 4 is a schematic diagram illustrating a differential input circuit according to the embodiment of the present disclosure. The differential input circuit 41 includes a sampling circuit 411 and a scaling circuit 413. The sampling circuit 411 further includes a first sampling path 411*a* and a second sampling path 411*b*, and the scaling circuit 413 further includes a first scaling path 413*a* and a second scaling path 413*b*. The first scaling path 413*a* is electrically connected to the first sampling path 411*a* and the selection circuit 43. The second scaling path 413*b* is electrically connected to the second sampling path 411*b* and the selection circuit 43.

The sampling circuit 411 receives the analog voltage signal $V_{th}$ and a reference voltage $V_{ref}$. The first sampling circuit 411*a* selectively generates a first sampling voltage $\Delta V_{c1}$ according to the analog voltage signal $V_{th}$ and the reference voltage $V_{ref}$, that is, $\Delta V_{c1}=V_{th}-V_{ref}$. The second sampling path 411*b* selectively generates a second sampling voltage $\Delta V_{c2}$ according to the reference voltage $V_{ref}$ and the analog voltage signal $V_{th}$.

The first scaling path 413*a* receives the first sampling voltage $\Delta V_{c1}$ and a first shift voltage $V_{shft1}$, down scales the first sampling voltage $\Delta V_{c1}$ to a first scaled voltage $\Delta V_{cs1}$ with a first scaling ratio $r_{s1}$, and generates one of the pair of differential input signals (for example, a non-inverting differential input signal $V_{in+}$) according to the first shift voltage $V_{shft1}$ and the first scaled voltage $\Delta V_{cs1}$. That is, $\Delta V_{cs1}=\Delta V_{c1}*r_{s1}$, and $V_{in+}=V_{shft1}+\Delta V_{c1}*r_{s1}=V_{shft1}+\Delta V_{cs1}$.

The second scaling path 413*b* receives the second sampling voltage $\Delta V_{c2}$ and a second shift voltage $V_{shft1}$, down scales the second sampling voltage $\Delta V_{c2}$ to a second scaled voltage $\Delta V_{cs2}$ with a second scaling ratio $r_{s2}$, and generates the other one of the pair of differential input signals (for example, an inverting differential input signal $V_{in-}$) according to the second shift voltage $V_{shft2}$ and the second scaled voltage $\Delta V_{cs2}$. That is, $\Delta V_{cs2}=\Delta V_{c2}*r_{s2}$, and $V_{in-}=V_{shft2}+\Delta V_{c2}*r_{s2}=V_{shft2}+\Delta V_{cs2}$.

According to the embodiment of the present disclosure, the first and the second shift voltages $V_{shft1}$, $V_{shft2}$ are direct current (hereinafter, DC) voltages, and the first shift voltage $V_{shft1}$ is less than the second shift voltage $V_{shft2}$ ($V_{shft1}<V_{shft2}$). Moreover, a range of the pair of differential input signals ($V_{in+}$, $V_{in-}$) is less than or equivalent to the difference between the first and the second shift voltages $V_{shft1}$, $V_{shft2}$. That is, $|V_{in+}-V_{in-}|\leq|V_{shft1}-V_{shft2}|$. According to the embodiment of the present disclosure, the first shift voltage $V_{shft1}$ and the second shift voltage $V_{shft2}$ may have the same absolute values and inversed polarities that are relative to a reference point. For example, the first shift voltage $V_{shft1}$ is −0.5V, and the second shift voltage $V_{shft2}$ is +0.5V, relative to a reference point 0V; or, the first shift voltage $V_{shft1}$ is +1V and the second shift voltage $V_{shft2}$ is +2V, relative to a reference point +0.5V.

The selection circuit 43 includes a first selection switch $SW_{sel1}$ and a second selection switch $SW_2$. The selection circuit 43 is electrically connected to the gain amplifier 45. When the channel selection signal $EN_{sel}$ corresponding to the differential input circuit 41 is at the high voltage level, the first selection switch $SW_{sel1}$ and the second selection switch $SW_{sel2}$ are switched on so that the first selection switch $SW_{sel1}$ conducts the non-inverting differential input signal $V_{in+}$ to the gain amplifier 45 and the second selection switch $SW_{sel2}$ conducts the inverting differential input signal $V_{in-}$ to the gain amplifier 45.

Figure 5:
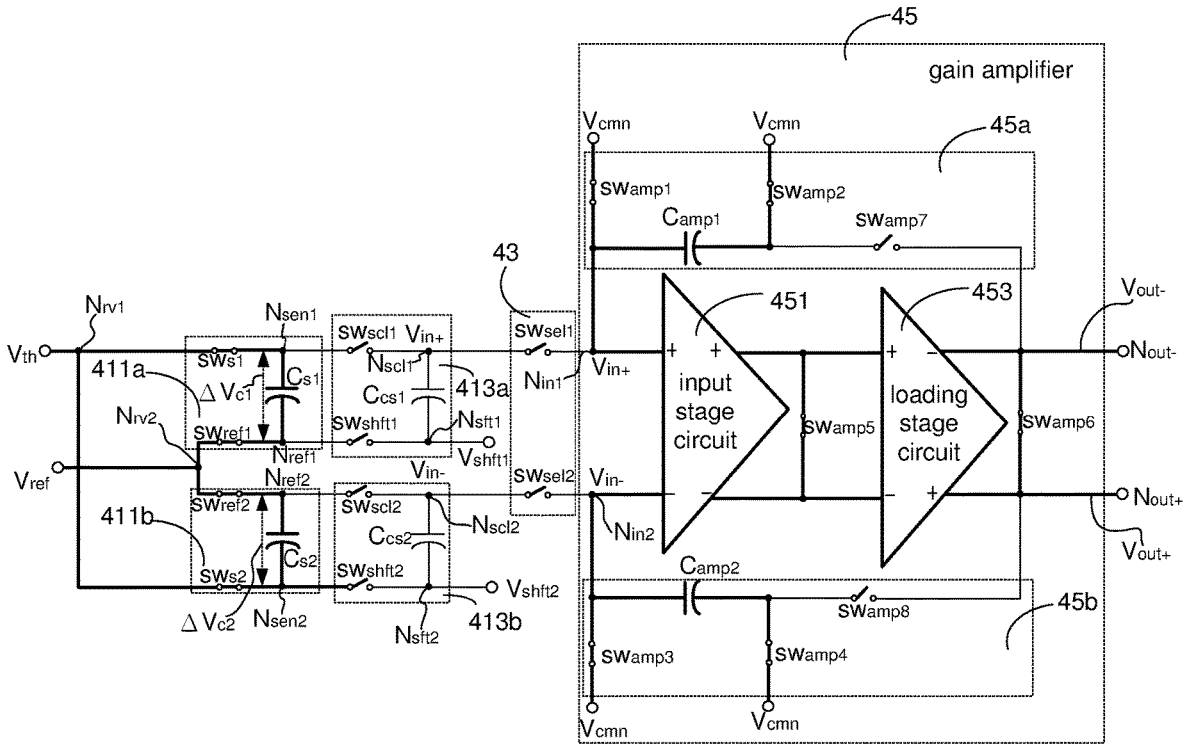
FIG. 5 and FIG. 6 are schematic diagrams respectively illustrating the differential input circuit operating in a sampling phase and in a hold phase (voltage scaling phase) according to the embodiment of the present disclosure.
Figure 6:
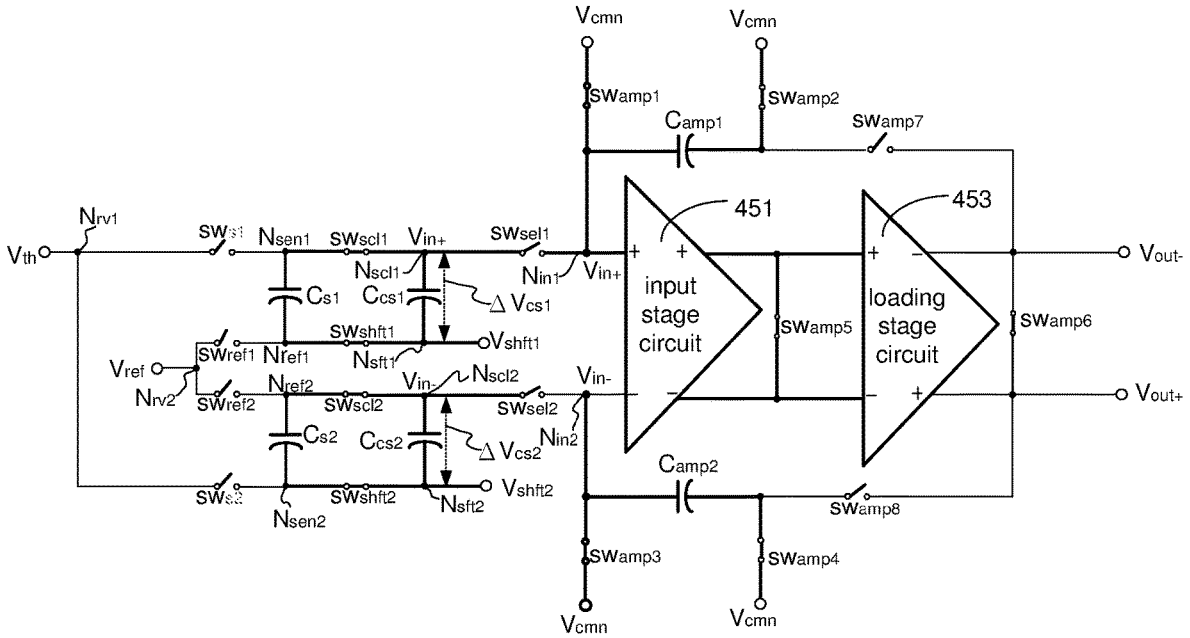

FIG. 5 and FIG. 6 are schematic diagrams respectively illustrating the differential input circuit operating in a sampling phase and in a hold phase (voltage scaling phase) according to the embodiment of the present disclosure. FIG. 5 is corresponding to the condition that the sampling enable signal $EN_{sam}$ is at the high voltage level (for example, the first duration T1 shown in FIG. 3B). FIG. 6 is corresponding to the condition that the sampling enable signal $EN_{sam}$ transits to the low voltage level and the scaling enable signal $EN_{scl}$ is at the high voltage level (for example, the second duration T2 shown in FIG. 3B).

The internal components of the first sampling path 411*a* and the first scaling path 413*a*, and those of the second sampling path 411*b* and the second scaling path 413*b* are symmetric.

The first sampling path 411*a* and the first scaling path 413*a* jointly generate the non-inverting differential input signal $V_{in+}$ based on the analog voltage signal $V_{th}$, the reference voltage $V_{ref}$ and the first shift voltage $V_{shft1}$, accompanied with control of the sampling enable signal $EN_{sam}$, and the scaling enable signal $EN_{scl}$.

The first sampling path 411*a* includes a first sampling switch $sw_{s1}$, a first reference switch $sw_{ref1}$ and a first sampling capacitor $C_{s1}$. The first sampling switch $sw_{s1}$ is electrically connected to a first receiving terminal $N_{rv1}$ and a first sensing terminal $N_{sen1}$. The first reference switch $sw_{ref1}$ is electrically connected to a second receiving terminal $N_{rv2}$ and a first reference terminal $N_{ref1}$. The first sampling capacitor $C_{s1}$ is electrically connected to the first sensing terminal $N_{sen1}$, and the first reference terminal $N_{ref1}$. When the sample enable signal $EN_{sam}$ is at the high voltage level, the first sampling switch $sw_{s1}$ transmits/conducts the analog voltage signal to the first sensing terminal $N_{sen1}$ and the first reference switch $sw_{ref1}$ transmits/conducts the reference voltage $V_{ref}$ to the first reference terminal $N_{ref1}$ such that the first sampling capacitor $C_{s1}$ are charged, and the first sampling voltage $\Delta V_{c1}$ is generated between the first sensing terminal $N_{sen1}$ and the first reference terminal $N_{ref1}$.

The first scaling path 413*a* includes a first scaling switch $sw_{scl1}$, a first shift switch $sw_{shft1}$, and a first charge sharing capacitor $C_{cs1}$. The first scaling switch $sw_{scl1}$ is electrically connected to the first sensing terminal $N_{sen1}$ and a first scaling terminal $N_{scl1}$. The first shift switch $sw_{shft1}$ is electrically connected to the first reference terminal $N_{ref}$ and a first shift terminal $N_{sft1}$. The first charge sharing capacitor $C_{cs1}$ is electrically connected to the first scaling terminal $N_{scl1}$ and the first shift terminal $N_{sft1}$.

When the scaling enable signal $EN_{scl}$ is at the high voltage level, the first scaling switch $sw_{scl1}$ conducts the first sensing terminal $N_{sen1}$ to the first scaling terminal $N_{scl1}$, and the first shift switch $sw_{shft1}$ conducts the first reference terminal $N_{ref1}$ to the first shift terminal $N_{sft1}$. Meanwhile, the first charge sharing capacitor $C_{cs1}$ receives the first shift voltage $V_{shft1}$ through the first shift terminal $N_{sft1}$, and charges stored in the first sampling capacitor $C_{s1}$ are shared by the first sampling capacitor $C_{s1}$ and the first charge sharing capacitor $C_{cs1}$.

The second sampling path 411*b* and the second scaling path 413*b* jointly generate the inverting differential input signal $V_{in-}$ based on the analog voltage signal $V_{th}$, the reference voltage $V_{ref}$ and the second shift voltage $V_{shft2}$, accompanied with control of the sampling enable signal $EN_{sam}$ and the scaling enable signal $EN_{scl}$. Since the implementation of the second sampling path 411*b* and the second scaling path 413*b* are similar to those of the first sampling path 411*a* and the first scaling path 413*a*, details of which are not redundantly described.

The first sampling switch $sw_{s1}$ and the first reference switch $sw_r$, are switched on when the sampling enable signal $EN_{sam}$ is at the high voltage level. Meanwhile, the first sampling capacitor $C_{s1}$ is charged, and the first sampling voltage $\Delta V_{c1}$ is generated between the first sensing terminal $N_{sen1}$ and the first reference terminal $N_{ref1}$. When the scaling enable signal $EN_{scl}$ is at the high voltage level, charges being accumulated in the first sampling capacitor $C_{s1}$ in the sensing phase is jointly shared by two capacitors, that is, the first sampling capacitor $C_{s1}$ and the first charge sharing capacitor $C_{cs1}$. In consequence, the voltage between the first scaling terminal $N_{scl1}$ and the first shift terminal $N_{sft1}$ decreases and becomes less than the first sampling voltage $\Delta V_{c1}$. The voltage between the first scaling terminal $N_{scl1}$ and the first shift terminal $N_{sft1}$ after being scaled down is defined as a first scaled voltage $\Delta V_{cs1}$.

Similarly, the second sampling switch $sw_{s2}$ and the second reference switch $sw_{ref2}$ are switched on when the sampling enable signal $EN_{sam}$ is at the high voltage level. Meanwhile, the second sampling capacitor $C_{s2}$ is charged, and the second sampling voltage $\Delta V_{c2}$ is generated between the second reference terminal $N_{ref2}$ and the second sensing terminal $N_{sen2}$. When the scaling enable signal $EN_{scl}$ is at the high voltage level, charges being accumulated in the second sampling capacitor $C_{s2}$ in the sensing phase is jointly shared by two capacitors, that is, the first sampling capacitor $C_{s1}$ and the first charge sharing capacitor $C_{cs1}$. In consequence, the voltage between the second scaling terminal $N_{scl2}$ and the second shift terminal $N_{sft2}$ decreases and becomes less than the second sampling voltage $\Delta V_{c2}$. The voltage between the second scaling terminal $N_{scl2}$ and the second shift terminal $N_{sft2}$ after being scaled down is defined as a second scaled voltage $\Delta V_{cs2}$.

According to the embodiment of the present disclosure, the reference voltage $V_{ref}$, the first shift voltage $V_{shft1}$ and the second shift voltage $V_{shft2}$ are direct current voltages. The first shift voltage $V_{shft1}$ is lower than the second shift voltage $V_{shft2}$ ($V_{shft1}<V_{shft2}$). The difference between the first and the second shift voltages ($\Delta V_{shft}$) can be represented as $\Delta V_{shft}=V_{shft2}-V_{shft1}$. Ranges of the pairs of the differential input signals ($V_{in+(ch1)}$, $V_{in-(ch1)}$), ($V_{in+(ch2)}$, $V_{in-(ch2)}$) are less than or equivalent to the difference between the first and the second shift voltages ($\Delta V_{shft}$).

As shown in FIG. 5, the gain amplifier 45 can include an input stage circuit 451, a loading stage circuit 453, an interconnection path, a first conduction path 45*a*, and a second conduction path 45*b*. The first conduction path 45*a* is electrically connected to the first input terminal $N_{in1}$ and the first output terminal $N_{out-}$, and the second conduction path 45*b* is electrically connected to the second input terminal $N_{in2}$ and the second output terminal $N_{out+}$.

The input stage circuit 451 is electrically connected to the selection circuit 43, from which the differential input signals $V_{in+}$, $V_{in-}$ are received. The loading stage circuit 453 is electrically connected to the input stage circuit 452, the first output terminal $N_{out-}$, and the second output terminal $N_{out+}$. The interconnection path includes switches $sw_{amp5}$, $sw_{amp6}$, the first conduction path 45*a* includes switches $sw_{amp1}$, $sw_{amp2}$, $sw_{amp7}$, and an amplification capacitor $C_{amp1}$, and the second conduction path 45*b* includes switches $sw_{amp3}$, $sw_{amp4}$, $sw_{amp8}$, and another amplification capacitor $C_{amp2}$.

When the gain amplifier 45 operates in the common mode ($M_{cmn}$), switches $sw_{amp1}$, $sw_{amp2}$, $sw_{amp3}$, $sw_{amp4}$, swamps, $sw_{amp6}$ are switched on, and switches $sw_{amp7}$, $sw_{amp8}$ are switched off. Through switches $sw_{amp1}$, $sw_{amp2}$, the first conduction paths 45*a* receive the common mode voltage $V_{cmn}$. Through switches $sw_{amp3}$, $sw_{amp4}$, the second conduction paths 45*b* receive the common mode voltage $V_{cmn}$.

When the gain amplifier 45 operates in the amplification mode ($M_{amp}$), the first conduction path 45*a* generates an inverting differential output signal $V_{out-}$ based on the common mode voltage $V_{cmn}$ and the pair of differential input signals ($V_{in+}$, $V_{in-}$), and the second conduction path 45*b* generates the non-inverting differential output signal $V_{out+}$ based on the same.

As for the gain amplifier 45, FIG. 6 is corresponding to the condition that the gain amplifier 45 is in the common mode ($M_{cmn}$) (for example, the fifth duration T5 shown in FIG. 3B).

Since the first scaling switch $sw_{scl1}$ and the first shift switch $sw_{shft1}$ are turned on by the scaling enable signal $EN_{scl}$, the first charge sharing capacitor $C_{cs1}$ shares charges stored in the first sampling capacitor $C_{s1}$. In consequence, the first sampling voltage $\Delta V_{c1}$ is down scaled to the first scaled voltage $\Delta V_{cs1}$, and the non-inverting differential input signal $V_{in+}$ is generated at the first scaling terminal $N_{scl1}$. The generation of the non-inverting differential input signal $V_{in+}$ can be represented as equation (1).

$$V_{in+} = V_{shift1} + \Delta V_{c1} * r_{s1} = V_{shift1} + \Delta V_{cs1} = V_{shift1} + \Delta V_{c1} * C_{s1} / (C_{s1} + C_{cs1}) \quad \text{equation (1)}$$

Since the second scaling switch $sw_{scl2}$ and the second shift switch $sw_{shft2}$ are turned on by the scaling enable signal $EN_{scl}$, the second charge sharing capacitor $C_{cs2}$ shares charges stored in the second sampling capacitor $C_{s2}$. In consequence, the second sampling voltage $\Delta V_{c2}$ is down scaled to the second scaled voltage $\Delta V_{cs2}$, and the inverting differential input signal $V_{in-}$ is generated at the second scaling terminal $N_{scl2}$. Generation of the inverting differential input signal $V_{in-}$ can be represented as equation (2).

$$V_{in-} = V_{shift2} + \Delta V_{cs2} = V_{shift2} + \Delta V_{c2} * C_{s2} / (C_{s2} + C_{cs2}) \quad \text{equation (2)}$$

The first sampling capacitor $C_{s1}$ receives the analog voltage signal $V_{th}$ and the reference voltage $V_{ref}$ with its anode and cathode, respectively. The second sampling capacitor $C_{s2}$ receives the analog voltage signal $V_{th}$ and the reference voltage $V_{ref}$ with its cathode and anode, respectively. Based on the assumption that $C_{s1}=C_{s2}$, magnitudes of the first sampling voltage $\Delta V_{c1}$ and the second sampling voltage $\Delta V_{c1}$ are equivalent but polarities of the first sampling voltage $\Delta V_{c1}$ and the second sampling voltage $\Delta V_{c2}$ are opposite.

The first scaling ratio $r_{s1}$ between the first scaled voltage $\Delta V_{cs1}$ and the first sampling voltage $\Delta V_{c1}$ thus can be determined based on capacitances of the first sampling capacitor $C_{s1}$ and the first charge sharing capacitor $C_{cs1}$. For example, in a case that Cs1=C and Ccs1=2*C, $\Delta V_{cs1}=\frac{1}{3}*\Delta V_{c1}$. Similarly, the second scaling ratio $r_{s2}$ between the second scaled voltage $\Delta V_{cs2}$ and the second sampling voltage $\Delta V_{c2}$ can be determined based on capacitances of the second sampling capacitor $C_{s2}$ and the second charge sharing capacitor $C_{cs2}$.

According to the embodiment of the present disclosure, capacitances of the first sampling capacitor $C_{s1}$ and the second sampling capacitor $C_{s2}$ are equivalent, and capacitances of the first charge sharing capacitor $C_{cs1}$ and the second charge sharing capacitor $C_{cs2}$ are equivalent. Therefore, the first scaling ratio $r_{s1}$ is equivalent to the second scaling ratio $r_{s2}$.

Based on these equivalences ($C_{s1}=C_{s2}$, $C_{cs1}=C_{cs2}$, and $\Delta V_{c2}=-\Delta V_{c1}$), equation (2) can be re-written as equation (3).

$$V_{in-} = V_{shift2} + \Delta V_{cs2} = V_{shift2} + \Delta V_{c2}{}^{*}C_{s2}/(C_{s2}+C_{cs2}) = V_{shift2} - \Delta V_{c1}{}^{*}C_{s1}/(C_{s1}+C_{cs1}) \quad \text{equation (3)}$$

Figure 7:
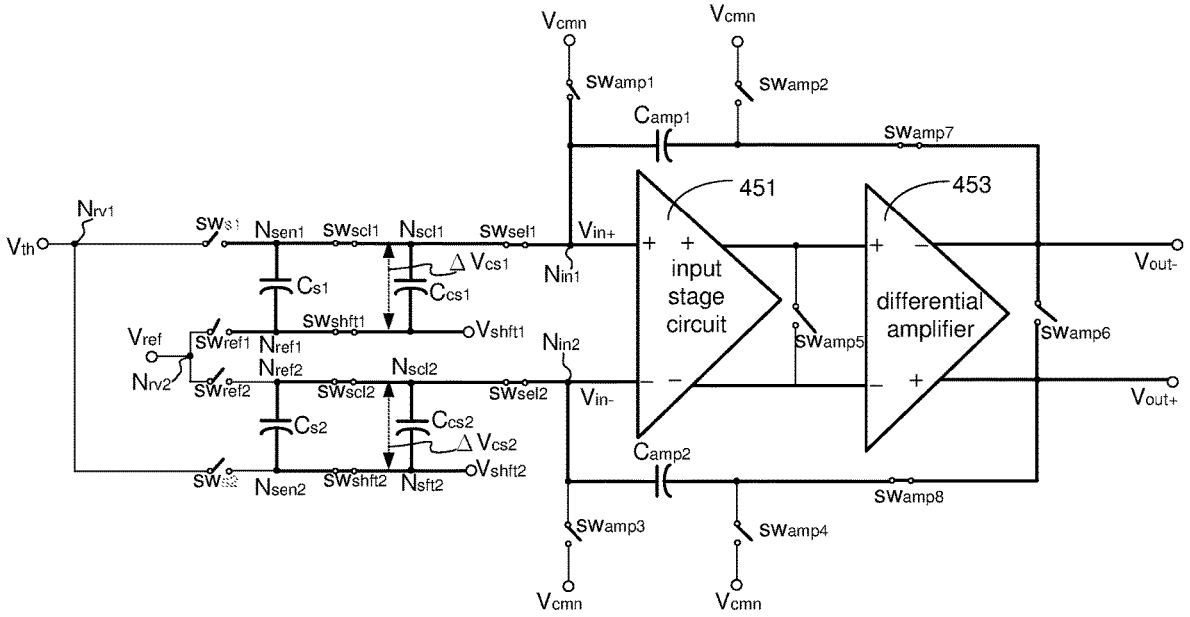
FIG. 7 is a schematic diagram illustrating the gain amplifier operates in the amplification mode.

FIG. 7 is a schematic diagram illustrating the gain amplifier operates in the amplification mode ($M_{amp}$). FIG. 7 is corresponding to the sixth duration T6 shown in FIG. 3B.

When the gain amplifier 45 operates in the amplification mode ($M_{amp}$), switches $sw_{amp1}$, $sw_{amp2}$, $sw_{amp3}$, $sw_{amp4}$, $sw_{amp5}$, swamps are switched off, and switches $sw_{amp7}$, $sw_{amp8}$ are switched on. Through amplification capacitor $C_{amp1}$ and switch $sw_{amp7}$, the first conduction path 45*a* feedbacks the inverting differential output signal $V_{out-}$ from the first output terminal $N_{out-}$ to the first differential input terminal $N_{in1}$. Through amplification capacitor $C_{amp2}$ and switch $sw_{amp8}$, the second conduction path 45*b* feedbacks the non-inverting differential output signal $V_{out+}$ from the second output terminal $N_{out+}$ to the second differential input terminal $N_{in2}$. In FIG. 7, the first conduction path 45*a* generates the inverting differential output signal $V_{out-}$ based on the common mode voltage $V_{cmn}$ and the differential input signals ($V_{in+}$, $V_{in-}$), and the second conduction path 45*b* generates the non-inverting differential output signal $V_{out+}$ based on the same.

Figure 8:
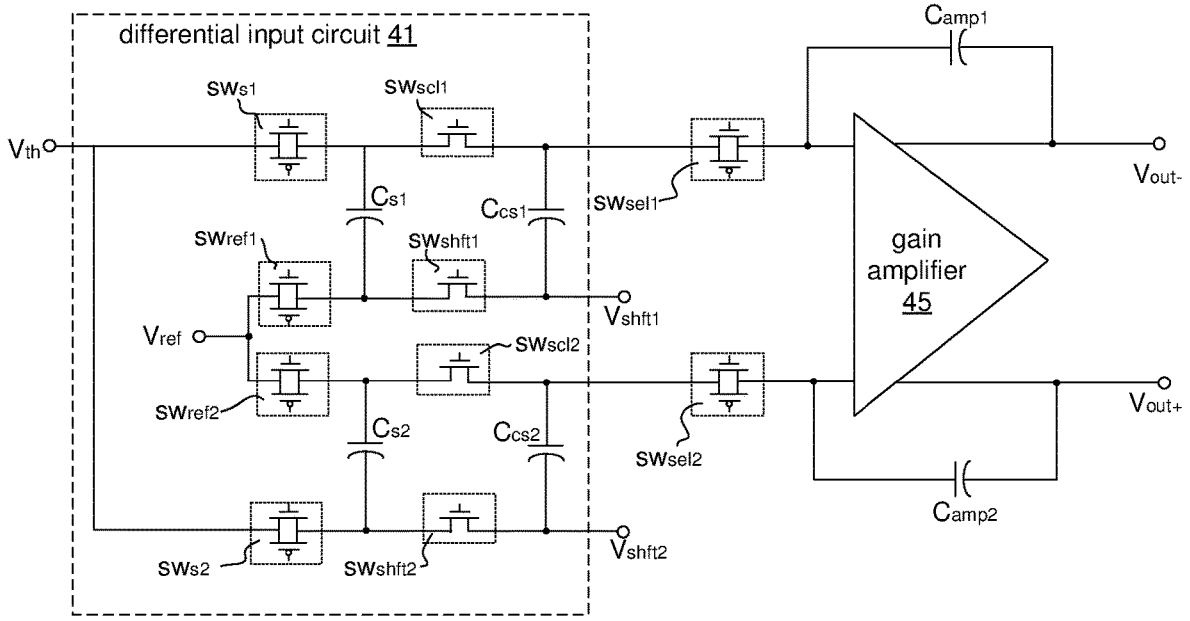
FIG. 8 is a schematic diagram illustrating an example of the implementation of the differential input circuit according to the embodiment of the present disclosure.

FIG. 8 is a schematic diagram illustrating an example of the implementation of the differential input circuit according to the embodiment of the present disclosure. As shown in FIG. 8, the first sampling switch $sw_{s1}$, the second sampling switch $sw_{s2}$, the first reference switch $sw_{ref1}$, the second reference switch $sw_{ref2}$, the first selection switch $sw_{scl1}$, and the second selection switch $sw_{sel2}$ can be implemented by transmission gates; and the first scaling switch $sw_{scl1}$, the second scaling switch $sw_{shft2}$, the first shift switch $sw_{shft1}$, and the second shift switch $sw_{shft2}$ can be implemented by NMOS transistors. The implementation shown in FIG. 8 is an example, and the implementation in practical applications may vary.

Figure 9:
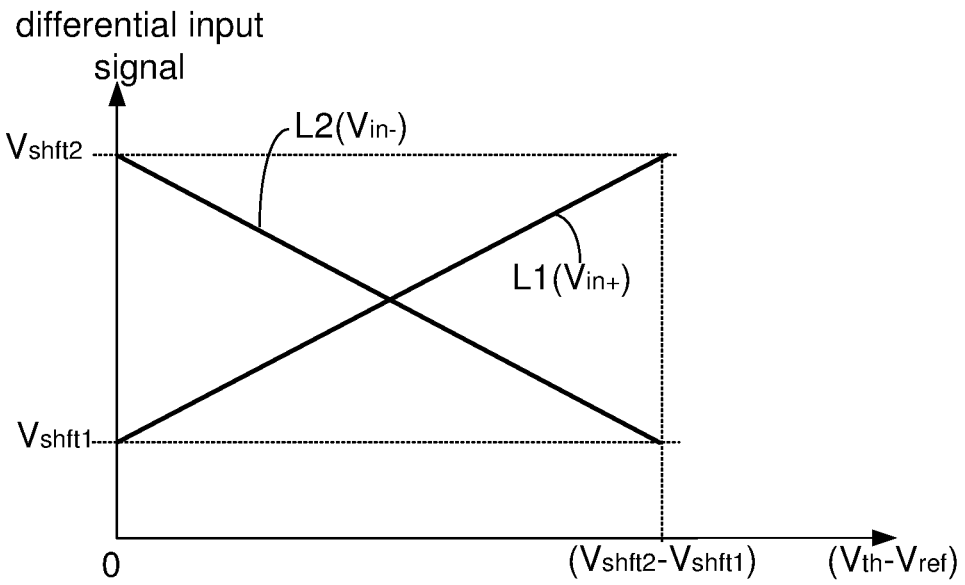
FIG. 9 is a schematic diagram illustrating the characteristic of the differential input circuit according to the embodiment of present disclosure.

FIG. 9 is a schematic diagram illustrating the characteristic of the differential input circuit according to the embodiment of present disclosure. The horizontal axis represents the input voltage ($V_{th}-V_{ref}$) of the differential input circuit 41, and the vertical axis represents the differential output signals of the differential input circuit 41, that is, the differential input signal of the gain amplifier 45. In FIG. 9, line L1 represents the non-inverting differential input signal $V_{in+}$, and line L2 represents the inverting differential output signal $V_{in-}$.

Figure 10:
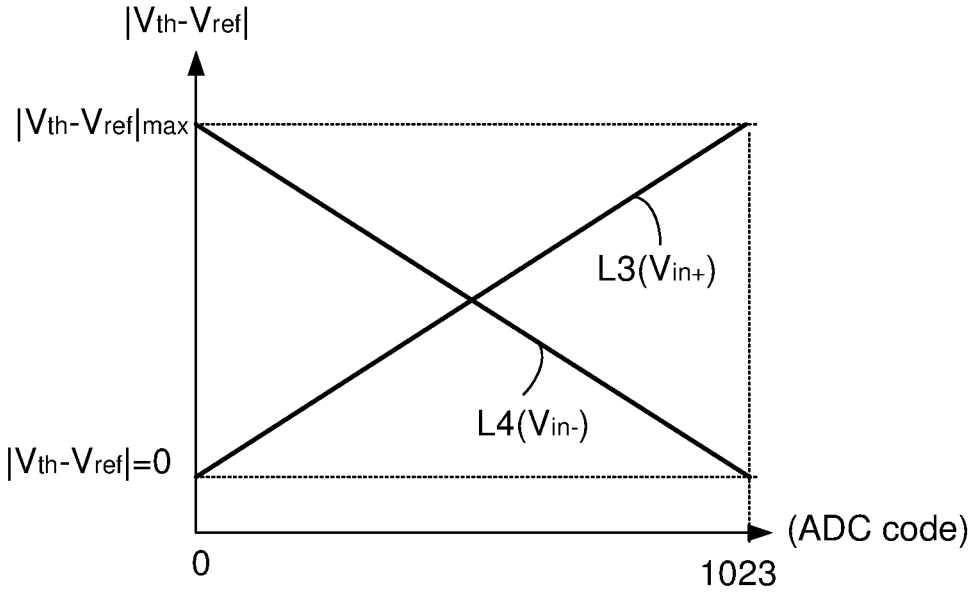
FIG. 10 is a schematic diagram illustrating the conversion characteristic of the ADC.

FIG. 10 is a schematic diagram illustrating the conversion curve of the input voltage ($V_{th}-V_{ref}$) of the differential input circuit to the code output by the ADC. The vertical axis represents the input voltage ($V_{th}-V_{ref}$) of the differential input circuit. The horizontal axis represents the ADC code. In FIG. 10, the maximum of the input voltage of the differential input circuit, $(V_{th}-V_{ref})_{MAX}$, is corresponding to the largest ADC code, wherein the resolution of the ADC code is 10 bits as an example. Therefore, the smallest ADC code is assumed to be "0", and the largest ADC code is assumed to be "1023". In FIG. 10, line L3 represents the non-inverting differential input signal $V_{in+}$, and line L4 represents the inverting differential output signal $V_{in-}$.

Under the assumption that the ADC operates in a range of 1V (voltage between the gain amplifier output, that is, |Vout+−Vout−|, is equivalent to 1V (|Vout+−Vout−|=1V), and the gain of the gain amplifier is equivalent to 1, the first shift voltage $V_{sft1}$ can be designed as $V_{shft1}=-0.5$, and the second shift voltage $V_{shft2}$ can be designed as $V_{shft2}=+0.5V$ in order to satisfy with the relationship that $V_{shft2}-V_{shft1}=1V$.

In addition, under the same assumption that the down scaling ratio is assumed to be equivalent to ⅓, the input voltage ($V_{th}-V_{ref}$) of the differential input circuit must be less than or equivalent to 3V to ensure that the down-scaled voltage ($V_{in+}-V_{in-}$) is maintained to be less than or equivalent to 1V. That is, the non-inverting differential input signal $V_{in+}$ and the inverting differential input signal $V_{in-}$ must be satisfied with the following relationship: $|V_{in+}-V_{in-}|\leq|V_{shft1}-V_{shft2}|$.

The scenario that the analog voltage signal $V_{th}$ is equivalent to the minimum value and equivalent to the reference voltage Vref (for example, Vref=0V, Vth=0V) is discussed. Under such circumstance, the non-inverting differential input signal $V_{in+}$ is equivalent to the first shift voltage $V_{shft1}$ ($V_{in+}=-0.5+0*(\frac{1}{3})=-0.5V=V_{shft1}$), according to equation (2). Moreover, according to equation (3), the inverting differential input signal $V_{in-}$ is equivalent to the second shift voltage $V_{shft2}$ ($V_{in-}=+0.5+0*(\frac{1}{3})=+0.5V=V_{shft2}$).

The scenario that the analog voltage signal Vth is equivalent to 3V and the reference voltage Vref is equivalent to 0V (Vth=3V and Vref=0V) is discussed. Under such circumstance, the non-inverting differential input signal $V_{in+}$ is equivalent to the second shift voltage $V_{shft}$ ($V_{in+}=-0.5V+3*(\frac{1}{3})V=+0.5V$), according to equation (2). Moreover, according to equation (3), the inverting differential input signal $V_{in-}$ is equivalent to the first shift voltage $V_{shft1}$ ($V_{in-}=-0.5V+(-3)*(\frac{1}{3})=-0.5V=V_{shft1}$).

When the input voltage of the differential input circuit 41 ($V_{th}-V_{ref}$) is equivalent to zero, the analog voltage signal $V_{th}$ is equivalent to the reference voltage $V_{ref}$, and the first sampling voltage $\Delta V_{c1}$ is equivalent to zero. According to equation (1), the non-inverting differential input signal $V_{in+}$ can be obtained, that is, $V_{in+}=V_{shft1}+(0)*C_{s1}/(C_{s1}+C_{cs1})=V_{shft1}$. Similarly, according to equation (3), the inverting differential input signal $V_{in-}$ can be obtained, that is, $V_{in-}=V_{shft2}-(0)*C_{s1}/(C_{s1}+C_{cs1})=V_{shft2}$. Therefore, the non-inverting differential input signal $V_{in+}$ is equivalent to the first shift voltage $V_{shft1}$, and the inverting differential input signal $V_{in-}$ is equivalent to the second shift voltage $V_{shft2}$.

Based on the above illustrations, meanings of the lines L3, L4 in FIG. 10 are illustrated. When the input voltage of the differential input circuit 41, $(V_{th}-V_{ref})$ is equivalent to the minimum value $(V_{th}-V_{ref})_{min}$, the differential output $(V_{out+}-V_{out-})$ of the gain amplifier is equivalent to the minimum value, and the corresponding ADC code is the smallest (ADC code=0). On the other hand, when the input voltage of the differential input circuit, $(V_{th}-V_{ref})$ is equivalent to the maximum value $(V_{th}-V_{ref})_{max}$, the differential output $(V_{out+}-V_{out-})$ of the gain amplifier 45 is equivalent to the maximum value, and the corresponding ADC code is the largest (ADC code=1023).

According to the embodiment of the present disclosure, the differential input circuit receives the analog voltage signal $V_{th}$ in a single-ended manner but provides a pair of fully differential signals to the gain amplifier. Consequentially, the gain amplifier is not necessary to transform a single-ended input to a differential output. Alternatively speaking, the signal quality of the driving circuit can be improved when the differential input circuit is capable of providing the fully differential signals to the gain amplifier.

Although the illustrations above are based on the OLED display panel, the application of the present disclosure is not limited. Therefore, if there is a need for other display devices having the analog voltage signal to be scaled down, the embodiment of the present disclosure can be modified and applied.

While the invention has been described by way of example and in terms of the preferred embodiment(s), it is to be understood that the invention is not limited thereto. On the contrary, it is intended to cover various modifications and similar arrangements and procedures, and the scope of the appended claims therefore should be accorded the broadest interpretation so as to encompass all such modifications and similar arrangements and procedures.

What is claimed is:

1. A differential input circuit, for transforming an analog voltage signal corresponding to a sensing line on an OLED panel to a pair of differential input signals being output to a gain amplifier, wherein the differential input circuit comprises:

a sampling circuit, configured to receive the analog voltage signal and a reference voltage, comprising:

a first sampling path, configured to selectively sample the analog voltage signal to generate a first sampling voltage between a first sensing terminal and a first reference terminal according to the analog voltage signal and the reference voltage; and a second sampling path, configured to selectively sample the analog voltage signal to generate a second sampling voltage between a second reference terminal and a second sensing terminal according to the reference voltage and the analog voltage signal; and a scaling circuit, comprising:

a first scaling path, electrically connected to the first sensing terminal and the first reference terminal, configured to receive the first sampling voltage and a first shift voltage, down scale the first sampling voltage to a first scaled voltage, and generate one of the pair of differential input signals according to the first shift voltage and the first scaled voltage; and a second scaling path, electrically connected to the second sensing terminal and the second reference terminal, configured to receive the second sampling voltage and a second shift voltage, down scale the second sampling voltage to a second scaled voltage, and generate the other one of the pair of differential input signals according to the second shift voltage and the second scaled voltage, wherein the first and the second shift voltages are direct current voltages and the first shift voltage is less than the second shift voltage.

2. The differential input circuit according to claim 1, wherein the first scaling path receives the first shift voltage at a first shift terminal, and the second scaling path receives the second shift voltage at a second shift terminal, wherein a range of the pair of differential input signals is less than or equivalent to difference between the first and the second shift voltages.

3. The differential input circuit according to claim 1, wherein magnitudes of the first sampling voltage and the second sampling voltage are equivalent and polarities of the first sampling voltage and the second sampling voltage are opposite.

4. The differential input circuit according to claim 1, wherein the first sampling path comprises:

a first sampling switch, electrically connected to a first receiving terminal and the first sensing terminal, configured to transmit the analog voltage signal to the first sensing terminal according to a sample enable signal;

a first reference switch, electrically connected to a second receiving terminal and the first reference terminal, configured to transmit the reference voltage to the first reference terminal according to the sample enable signal; and a first sampling capacitor, electrically connected to the first sensing terminal and the first reference terminal, configured to be charged and generate the first sampling voltage when the first sampling switch and the first reference switch are switched on.

5. The differential input circuit according to claim 4, wherein the first scaling path comprises:

a first scaling switch, electrically connected to the first sensing terminal and a first scaling terminal, configured to conduct the first sensing terminal and the first scaling terminal according to a scaling enable signal;

a first shift switch, electrically connected to the first reference terminal and a first shift terminal, configured to conduct the first reference terminal and the first shift terminal according to the scaling enable signal; and a first charge sharing capacitor, electrically connected to the first scaling terminal and the first shift terminal, configured to receive the first shift voltage through the first shift terminal, share charges stored in the first sampling capacitor when the first scaling switch and the first shift switch are turned on and accordingly down scale the first sampling voltage to the first scaled voltage, wherein the one of the pair of differential input signals is generated at the first scaling terminal.

6. The differential input circuit according to claim 5, wherein a first scaling ratio between the first scaled voltage and the first sampling voltage is determined based on capacitances of the first sampling capacitor and the first charge sharing capacitor.

7. The differential input circuit according to claim 4, wherein the second sampling path comprises:

a second sampling switch, electrically connected to the first receiving terminal and the second sensing terminal, configured to transmit the analog voltage signal to the second sensing terminal according to the sample enable signal;

a second reference switch, electrically connected to the second receiving terminal and the second reference terminal, configured to transmit the reference voltage to the second reference terminal according to the sample enable signal; and a second sampling capacitor, electrically connected to the second reference terminal and the second sensing terminal, configured to be charged and generate the second sampling voltage when the second sampling switch and the second reference switch are switched on.

8. The differential input circuit according to claim 7, wherein the second scaling path comprises:

a second scaling switch, electrically connected to the second reference terminal and a second scaling terminal, configured to conduct the second reference terminal and the second scaling terminal according to a scaling enable signal;

a second shift switch, electrically connected to the second sensing terminal and a second shift terminal, configured to conduct the second sensing terminal and the second shift terminal according to the scaling enable signal; and a second charge sharing capacitor, electrically connected to the second scaling terminal and the second shift terminal, configured to receive the second shift voltage through the second shift terminal, share charges stored in the second sampling capacitor when the second scaling switch and the second shift switch are turned on and accordingly down scale the second sampling voltage to the second scaled voltage, wherein the other one of the pair of differential input signals is generated at the second scaling terminal.

9. The differential input circuit according to claim 8, wherein a second scaling ratio between the second scaled voltage and the second sampling voltage is determined based on capacitances of the second sampling capacitor and the second charge sharing capacitor.

10. A driving circuit of a display device, comprising:

a differential input circuit, for transforming an analog voltage signal corresponding to a sensing line on an OLED panel to a pair of differential input signals, wherein the differential input circuit comprises:

a sampling circuit, configured to receive the analog voltage signal and a reference voltage, comprising:

a first sampling path, configured to selectively sample the analog voltage signal to generate a first sampling voltage between a first sensing terminal and a first reference terminal according to the analog voltage signal and the reference voltage; and a second sampling path, configured to selectively sample the analog voltage signal to generate a second sampling voltage between a second reference terminal and a second sensing terminal according to the reference voltage and the analog voltage signal; and a scaling circuit, comprising:

a first scaling path, electrically connected to the first sensing terminal and the first reference terminal, configured to receive the first sampling voltage and a first shift voltage, down scale the first sampling voltage to a first scaled voltage, and generate one of the pair of differential input signals according to the first shift voltage and the first scaled voltage; and a second scaling path, electrically connected to the second sensing terminal and the second reference terminal, configured to receive the second sampling voltage and a second shift voltage, down scale the second sampling voltage to a second scaled voltage, and generate the other one of the pair of differential input signals according to the second shift voltage and the second scaled voltage, wherein the first and the second shift voltages are direct current voltages and the first shift voltage is less than the second shift voltage; and a gain amplifier, electrically connected to the differential input circuit, comprising a first input terminal, a second input terminal, a first output terminal and a second output terminal, configured to receive the pair of differential input signals through the first and the second input terminals and generate a pair of differential output signals at the first and the second output terminals.

11. The driving circuit according to claim 10, wherein the first scaling path receives the first shift voltage at a first shift terminal, and the second scaling path receives the second shift voltage at a second shift terminal, wherein a range of the pair of differential input signals is less than or equivalent to difference between the first and the second shift voltages.

12. The driving circuit according to claim 10, wherein magnitudes of the first sampling voltage and the second sampling voltage are equivalent, and polarities of the first sampling voltage and the second sampling voltage are opposite.

13. The driving circuit according to claim 10, wherein the first sampling path comprises:

a first sampling switch, electrically connected to a first receiving terminal and the first sensing terminal, configured to transmit the analog voltage signal to the first sensing terminal according to a sample enable signal;

a first reference switch, electrically connected to a second receiving terminal and the first reference terminal, configured to transmit the reference voltage to the first reference terminal according to the sample enable signal; and a first sampling capacitor, electrically connected to the first sensing terminal and the first reference terminal, configured to be charged and generate the first sampling voltage when the first sampling switch and the first reference switch are switched on.

14. The driving circuit according to claim 13, wherein the first scaling path comprises:

a first scaling switch, electrically connected to the first sensing terminal and a first scaling terminal, configured to conduct the first sensing terminal and the first scaling terminal according to a scaling enable signal;

a first shift switch, electrically connected to the first reference terminal and a first shift terminal, configured to conduct the first reference terminal and the first shift terminal according to the scaling enable signal; and a first charge sharing capacitor, electrically connected to the first scaling terminal and the first shift terminal, configured to receive the first shift voltage through the first shift terminal, share charges stored in the first sampling capacitor when the first scaling switch and the first shift switch are turned on and accordingly down scale the first sampling voltage to the first scaled voltage, wherein the one of the pair of differential input signals is generated at the first scaling terminal.

15. The driving circuit according to claim 13, wherein the second sampling path comprises:

a second sampling switch, electrically connected to the first receiving terminal and the second sensing terminal, configured to transmit the analog voltage signal to the second sensing terminal according to the sample enable signal;

a second reference switch, electrically connected to the second receiving terminal and the second reference terminal, configured to transmit the reference voltage to the second reference terminal according to the sample enable signal; and a second sampling capacitor, electrically connected to the second reference terminal and the second sensing terminal, configured to be charged and generate the second sampling voltage when the second sampling switch and the second reference switch are switched on.

16. The driving circuit according to claim 15, wherein the second scaling path comprises:

a second scaling switch, electrically connected to the second reference terminal and a second scaling terminal, configured to conduct the second reference terminal and the second scaling terminal according to a scaling enable signal;

a second shift switch, electrically connected to the second sensing terminal and a second shift terminal, configured to conduct the second sensing terminal and the second shift terminal according to the scaling enable signal; and a second charge sharing capacitor, electrically connected to the second scaling terminal and the second shift terminal, configured to receive the second shift voltage through the second shift terminal, share charges stored in the second sampling capacitor when the second scaling switch and the second shift switch are turned on and accordingly down scale the second sampling voltage to the second scaled voltage, wherein the other one of the pair of differential input signals is generated at the second scaling terminal.

17. The driving circuit according to claim 10, further comprising:

a multiplexer selection circuit, electrically connected to the differential input circuit and the gain amplifier, configured to conduct the pair of differential input signals to the first and the second input terminals of the gain amplifier according to a channel selection signal.

18. The driving circuit according to claim 17, wherein the multiplexer selection circuit further comprises:

a first selection switch, electrically connected to the first scaling terminal and the gain amplifier, configured to conduct the one of the pair of differential input signals to the first input terminal of the gain amplifier; and a second selection switch, electrically connected to the second scaling terminal and the gain amplifier, configured to conduct the other one of the pair of differential input signals to the second input terminal of the gain amplifier.

19. The driving circuit according to claim 10, wherein the gain amplifier comprises:

an input stage circuit, electrically connected to the first and the second selection switches, configured to receive a common voltage or the pair of differential input signals;

a loading stage circuit, electrically connected to the input stage circuit, configured to generate the pair of differential output signals according to the common voltage or the pair of differential input signals.

20. The driving circuit according to claim 19, wherein the input stage circuit receives the common voltage when the channel selection signal represents the gain amplifier operates in a common mode; and the input stage circuit receives the pair of differential input signals when the channel selection signal represents the gain amplifier operates in an amplification mode.

* * * * *